US005265640A

United States Patent [19]

St. Amant

[11] Patent Number: 5,265,640

[45] Date of Patent: * Nov. 30, 1993

[54] SYSTEM FOR IDENTIFYING UNAUTHORIZED LIQUID WASTE AND WASTE WATER DISCHARGES

[76] Inventor: Joseph C. St. Amant, 1222 Rebekah Dr., Gulfport, Miss. 39503-2661

[ * ] Notice: The portion of the term of this patent subsequent to Feb. 12, 2008 has been disclaimed.

[21] Appl. No.: 834,616

[22] Filed: Feb. 12, 1992

[51] Int. Cl.[5] ..... G08B 1/00

[52] U.S. Cl. ..... 137/114; 116/211; 137/236.1; 137/551

[58] Field of Search ..... 137/114, 236.1, 551; 114/183 R, 184, 270; 116/211

[56] References Cited

U.S. PATENT DOCUMENTS

| | | | |
|---|---|---|---|
| 2,716,961 | 9/1955 | Manheim et al. | 116/124 |
| 3,048,464 | 8/1962 | Fisher | 8/79 |
| 3,115,861 | 12/1963 | Allen | 116/211 |
| 3,496,906 | 2/1970 | Gerke | 116/124 |
| 3,670,692 | 6/1972 | Jackson | 116/124 B |
| 3,768,436 | 10/1973 | Martini | 116/124 B |
| 3,874,326 | 4/1975 | Pickens | 116/124 B |
| 3,974,940 | 8/1976 | Bartik | 116/270 X |
| 4,376,421 | 3/1983 | Skinner | 116/211 |
| 4,886,607 | 12/1989 | Lalorde et al. | 114/270 X |
| 4,991,531 | 2/1991 | St. Amant | 114/183 R |

FOREIGN PATENT DOCUMENTS

| | | | |
|---|---|---|---|
| 1495016 | 12/1977 | United Kingdom | 114/270 |

*Primary Examiner*—Stephen M. Hepperle
*Attorney, Agent, or Firm*—Pravel, Hewitt, Kimball & Krieger

[57] ABSTRACT

A system for marking unauthorized discharge of liquid waste product includes a supply for containing a dye tracer product within the confines of a factory, refinery, or vessel, an interface line for adding the dye product via a flow line to the discharge line of a factory, refinery or vessel, a valve controller for valving the flow of dye product between the supply tank and the discharge line, an activating device for activating the valve controller responsive to the sensing of a preset level of liquid waste product flow being discharged via the discharge line, so that unauthorized discharges of waste material via the discharge line automatically activates the valve controller to mix a dye product contained within the supply tank with the unauthorized fluid discharge.

4 Claims, 2 Drawing Sheets

SYSTEM FOR IDENTIFYING UNAUTHORIZED LIQUID WASTE AND WASTE WATER DISCHARGES

BACKGROUND OF THE INVENTION

1. Field of the Invention

The present invention relates to aquatic signalling systems for use with spills, such as on the open sea, or in an industrial environment and more particularly relates to a system for signalling the unauthorized discharge of waste water and other undesirable waste material from industry, the bilge of ships or the like wherein a mandatory dye injection system marks any discharge. A control device injects a dye tracer into the discharge flowline so that any waste water discharge will be color dyed or magnetically identified in order to pinpoint the source of any unauthorized spills or discharges.

2. General Background

While the discharge of oil, bilge water, and/or other hazardous materials into the water is generally prohibited, many vessels discharge the ships bilge when on the open seas, often under the cover of darkness. This bilge discharge typically contains thick heavy oil material that forms tar like deposits upon beaches. Boats, and large ocean going vessels generate this waste material that collects in the bilge because of the presence typically of inboard engines. Thus, the bilges collect spoiled water, waste water, fuel oil, gasoline, lubricating oil and the like. Often-times, a bilge pump is operated to pump the mixture overboard, sometimes to a starting of the engine but typically when a vessel is far out to sea where it cannot be easily spotted.

In the disposal of waste water, industrial pollutants and the like, offenders sometimes discharge at night, hoping that the spill will fully dissipate in a few hours.

Some patents have issued which are directed to the problem of bilge water discharged by vessels. For example, in U.S. Pat. No. 3,913,513 issued to Pedone and entitled "Small Boat Oil Removal System For Bilge Water", there is provided an indicator which will change color when in contact with oil to provide a visual indication on the vessel when a filter needs changing. The filter is placed in a discharge line inboard of the vessel, out of view. The water and oil that is normally collected in the bilge of the boat is pumped overboard by a bilge pump with the oil being removed from the bilge water using the filter, the filter having layers of different sized expanded resin particles that are hydrophobic and oleophilic. When operation of the bilge pump ceases, a valve will release the back pressure that would otherwise be caused by the filter, to facilitate start up of the pump. Various patents relate to the problem of automatically discharging a dye material into the water for the purpose of marking a craft such as an airplane or military torpedo. For example, U.S. Pat. No. 3,049,091 entitled "Release And Injection Mechanism For Automatic Dye Marker System" and U.S. Pat. No. 4,376,421 entitled "Downed Aircraft Position Indicator" both describe dye marker constructions wherein an apparatus is provided for visually indicating the position of a downed aircraft to rescue personnel. In the Carroll U.S. Pat. No. 3,049,091, a crash market device is provided for marking the area in which an aircraft has submerged itself in a body of water. An injection mechanism having a releasable buoy unit is automatically ejected from the craft upon submerging which buoy may contain a quantity of dye for coloring the water surface.

In the Skinner U.S. Pat. No. 4,376,421 entitled "Down Aircraft Position Indicator", there is provided an apparatus for visually indicating the position of a downed aircraft to rescue personnel wherein a bright yellow or lime like color is stored in a pressurized tank during flight and means are provided whereby the substance is expelled from the aircraft responsive to separation of the craft's wings from the craft's fuselage, or to operator initiated control signals, are responsive to signals from a turning device.

Other patents which relate generally to water marking devices that use dyes can be seen in U.S. Pat. No. 2,675,776 entitled "Sea Marker"; U.S. Pat. No. 2,716,961 entitled "Water Marking Device"; and U.S. Pat. No. 3,768,436 entitled "Dye Release Apparatus".

In U.S. Pat. No. 2,704,043 there is provided a pick-up device for catapulted planes. The apparatus includes a water sled device for recovering objects from a body of water such as a catapulted plane. The sled device includes a pair of openended discharge pipes extending upwardly and respectively from each side of the sled device. A water intake funnel extending from the bottom portion of the sled device with its open end facing in a direction forwardly of the sled, a mixing valve having input and output passageways, a source of compressed air, respective fluid conduit means connecting the source of compressed air and the water intake funnel to the input passageway of the mixing valve where the compressed air and water are mixed, and fluid conduits connecting the output passageway of the mixing valve to the water discharge pipe whereby a vertical column of water is extruded from the discharge pipe locating the width and the location of the sled device. The discharge pipes can be equipped with dyeing chambers, located in the discharge pipes in order to color the water as the water is passed through the respective dyeing chambers and discharge pipes. The dye chamber contains a dye material in crystalline or powdered form which can be dissolved or mixed with the water passing through the chamber.

SUMMARY OF THE PRESENT INVENTION

The present invention provides a simple straightforward yet effective manner of marking unauthorized discharges from industrial plants, the bilge of ships, and the like even when such discharges are made at night, or far out to sea where immediate visual identification of the discharge is likely or even possible.

The present invention provides thus an improved apparatus and system for marking unauthorized discharge such as waste water material from a plant, factory or ship, even at open sea.

The apparatus includes a supply tank or like vessel for containing a dye product such as a liquid dye product. A discharge line pumping waste water to a discharge point is equipped with an interface for adding the dye tracer product to the waste water being discharged and prior to discharge.

A valve controller is mounted in a first dye product flowline forming a communication between the dye tracer product and the discharge flowline. An actuator activates the valve controller to open the dye product flowline responsive to a discharge of waste water via the discharge flowline.

Thus, the present invention provides a solution to the problem of identifying the location and the source of an oil or waste water discharge in an unauthorized fashion, even if under the cover of darkness on lakes, rivers, or at sea.

The present invention utilizes a dye product which can be a colored dye or a magnetic dye. Because the apparatus and system of the present invention contemplates that a particular factory or vessel carry a particular dye product, identification would simply be a matter of maintaining a sample of a dye contained with each factory or ship and a regulatory scheme of matching the offending dye product associated with an intentional unauthorized spill with dye samples maintained on record. Thus; not only would the present invention provide a system of immediately identifying unauthorized discharges of waste water material and the like, this system provides a deterrent in that operators are not likely to discharge bilge waste water and oil wherein such a magnetic or colored dye tracer product is necessarily by law to be added to any discharge.

Thus, with the present invention the color of a dye product and/or a magnetic indicator carried by the dye product can be identified by law enforcement personnel to identify the source of the spill.

With the present invention, the presence of a dye product mixed with an unauthorized discharge can be spotted from the air or from an enforcement vessel sampled and by color comparison or by magnetic analysis, the source of the discharge could be identified.

The present invention applies to any unauthorized pollution such as factory or refinery waste water, toxic waste, or any type of overboard discharge on board ships whether ocean going or smaller vessels. A typical dye product would be any suitable available dye tracer product such as a fluorescent type dye having maximum visibility. Variations and coloration could be used to assign a particular dye color to a particular vessel or to a particular company operating factories, refineries, or fleets of marine vessels.

The present invention could provide a sealed dye tracer tank and metering system which was sealed by governmental, Coast Guard, or like authorities so that tampering could immediately be determined from a visual inspection of the system when installed properly in a factory, refinery or upon a particular vessel.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
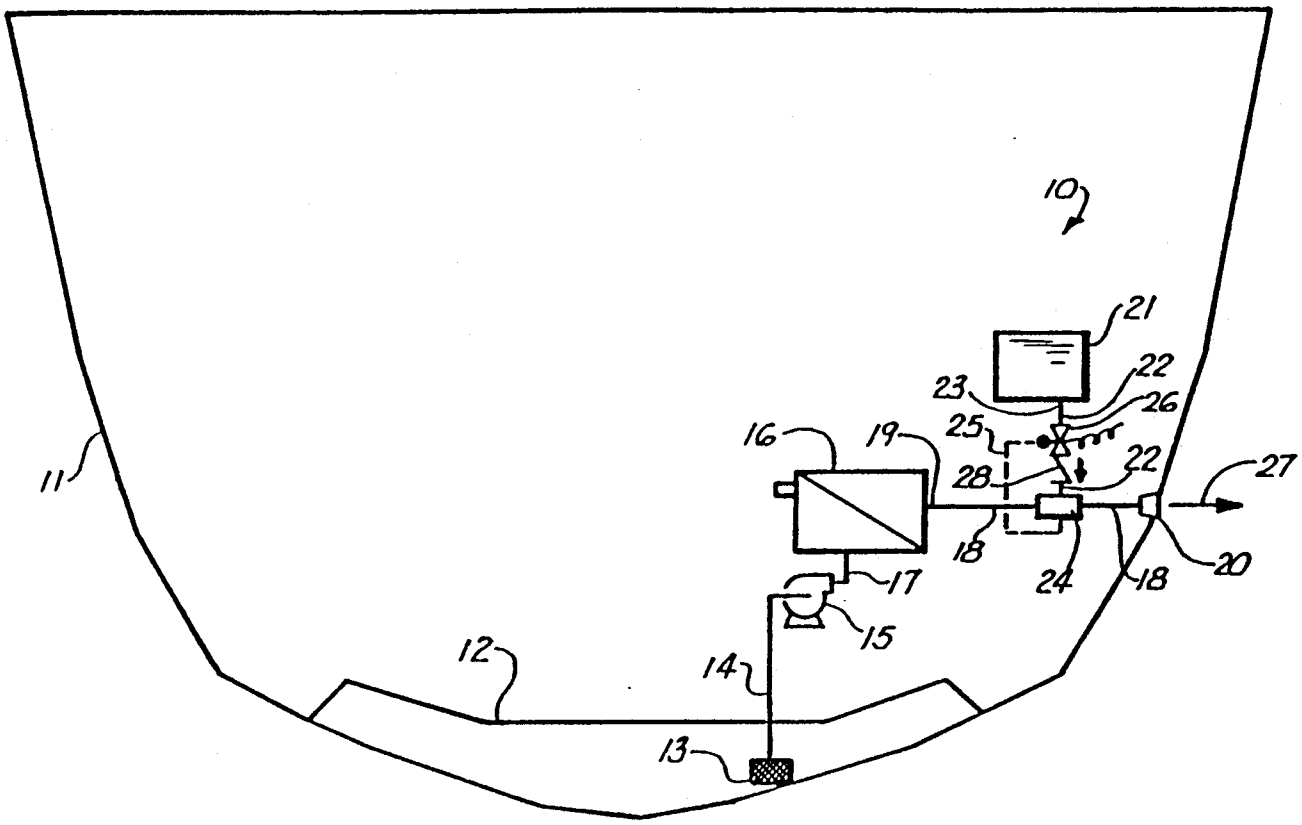
FIG. 1 is an elevational, schematic view illustrating the preferred embodiment of the apparatus of the present invention in a marine environment.

FIG. 1 illustrates the preferred embodiment of the liquid waste discharge monitoring apparatus of the present invention designated generally by the numeral 10. In FIG. 1 there can be seen a transverse sectional view of a ship's hull designated by the numeral 11 including a lowermost bilge section 12 which includes a bilge suction 13, suction line 14, a bilge discharge pump 15 and a separator vessel 16 which can be for example an oil/water type separator.

Bilge pump 15 includes a discharge line 17 for pumping bilge contents received via suction line 14 into oil/water separator 16. Overboard discharge line 18 extends from discharge port 19 of oil/water separator 16 and terminates at overboard discharge 20 which would be any commercially available fitting for placement in the ships hull as is commonly used in bilge discharge lines.

Between overboard discharge fitting 20 and discharge port 19 of oil/water separator 16 is overboard discharge line 18 which has been schematically illustrated using a single line drawing. However, it should be understood that the overboard discharge line 18 could be a collection different discharge pipes, manifolds or the like forming a part of the ship's existing overboard discharge system. The present invention, designated generally by the numeral 10 would be interfaced preferably between the discharge port 19 of the oil/water separator 16 and the overboard discharge fitting 20, placed in line in the bilge discharge line 18. The apparatus 10 includes a magnetic dye tracer tank 21 which would be a vessel having a volume to carry sufficient dye so that the surface of the marine environment, ocean, lake, river or the like would be marked with suitable dye so that aerial views or views by surface vessels would quickly demonstrate that a discharge of bilge water had been made. A mixer (not shown) would preferably be contained within tank 21 in order to insure uniform distribution of the contents of any contained dye product or magnetic dye product. Dye interface line 22 extends from discharge port 23 of dye tank 21, the line 22 interfacing with the overboard discharge line 18 at oil/sewerage monitor 24. The oil/sewerage monitor 24 could be a metering device which is commercially available that would sense a certain threshold part per million of oil or sewerage and at that point trigger the instrumentation line 25 normally closed control valve 26 so that dye product (for example a magnetic dye and/or colored dye would be injected via line 22 into the overboard discharge line 18 mixing with the bilge water and other waste material that is being pumped from bilge 12 via lines 14, 17 and 18 to overboard discharge fitting 20. The monitor 24, or a flow controller could limit the amount of dye discharged each time the bilge pump 15 is activated to a maximum volume of for example fifty to one hundred (50–100) gallons, or possibly some fixed percentage of the volume of dye in the tank 21. A mixture of dye product and the bilge discharge would be dumped into the surrounding body of water as indicated schematically by the arrow 27 in FIG. 1. Check valve 28 would prevent a back flow of bilge water via line 22 into tank 21. The preferred embodiment provides a tank 21 which is elevated so that gravity flow can be used to transmit dye product contained in tank 21 to overboard discharge line 18 via dye interface line 22. However, it should be understood that a pump could be used to enhance the flow of a desired volume of dye product from tank 21 to overboard discharge line 18.

Figure 2:
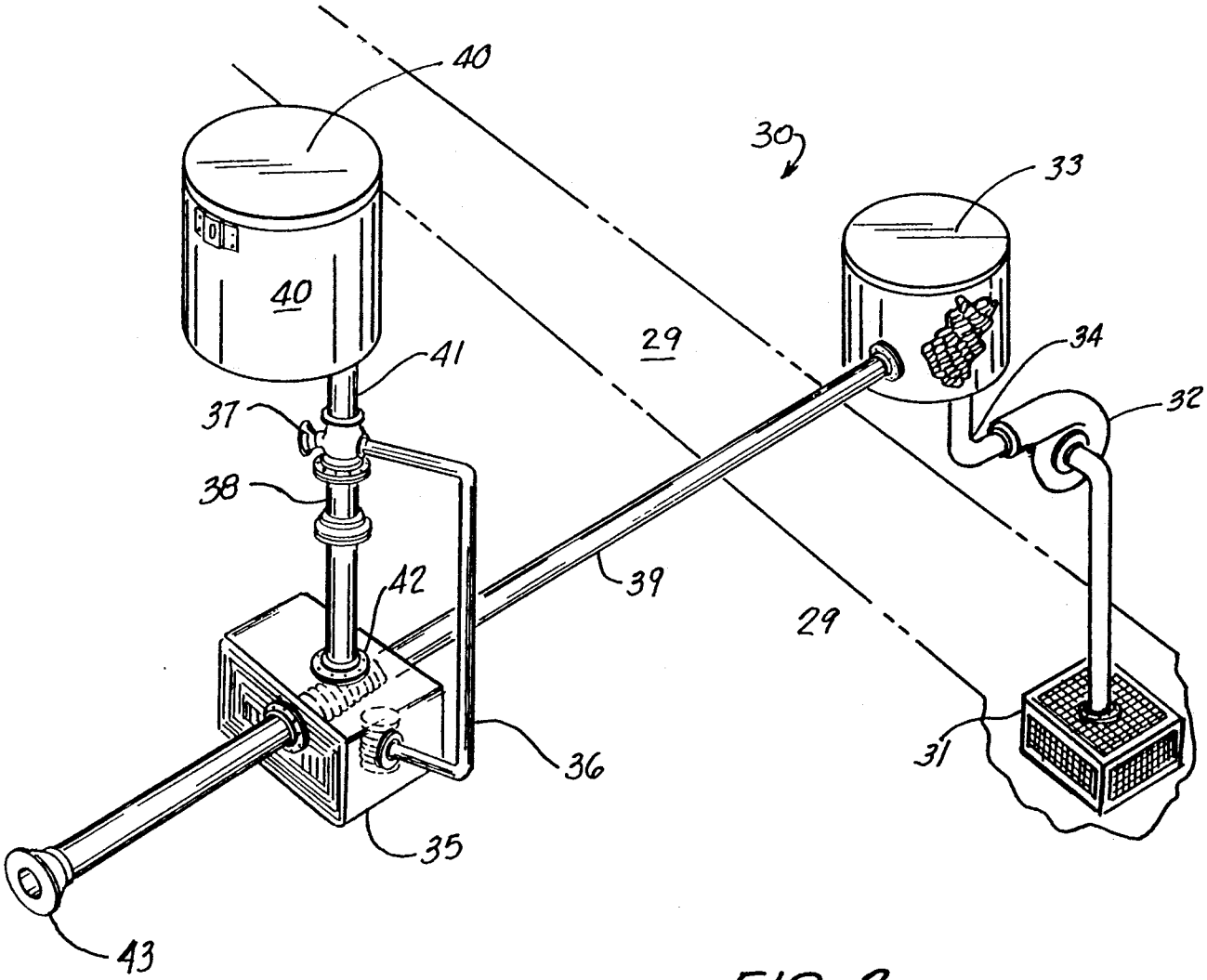
FIG. 2 is a perspective view of the preferred embodiment of the apparatus of the present invention in a land based environment.

FIG. 2 illustrates a land based liquid waste discharge monitoring apparatus, designated generally by the numeral 30. In FIG. 2, an open flow channel, designated generally by the numeral 29 represents a waste water discharge channel from a factory, refinery, or other like land based facility that generates a liquid waste product.

A screened suction inlet 31 is placed in the liquid waste discharge channel 29. Pump 32 receives the waste product and discharges the waste product via line 34 to a preliminary separator vessel 33. After discharging the separator vessel 33, liquid waste product enters flowline 39 which communicates with monitor 35. Monitor 35 could be the same type of monitor and with the same type of instrumentation as was described in the above discussed embodiment of FIG. 1.

Monitor 35 communicates with one end of instrumentation line 36. Line 36 communicates with control valve 37. Control valve 37 is placed in a dye discharge line 41 which communicates with dye tracer tank 40. When the control valve 37 is opened, dye product enters the line 41 and flows downwardly through control valve 37 and check valve 38 and into the main discharge flowline 39. The dye product mixes with liquid waste product that is discharged via the separator vessel and to the final discharge port 43.

The flow of dye from tank 40 via interface line 41 is controlled by opening of control valve 37 which is opened and closed using the instrumentation line 36.

Monitor 35 can be preset at a flow capacity level so that when a desired minimum amount of flow is exiting the final discharge port 43 via line 39, the monitor 35 detects such minimum flow level (such as for example fifty to one hundred gallons per minute) and activates the control valve via line 36 to release the dye. Federal or State officials could set minimums of discharge values such as a minimum capacity discharge of fifty to one hundred (50–100) gallons per minute for example. If that minimum permissible range of discharge was violated, the dye would be allowed to mix with the discharge line, thus marking the spill so that appropriate Federal or State officials could quickly identify it in the hours after the spill.

The following table lists the part numbers and part descriptions as used herein and in the drawings attached hereto.

TABLE

| 32 PARTS LIST | |
|---|---|
| Part Number | Description |
| 10 | waste discharge monitor |
| 11 | ship's hull |
| 12 | bilge |
| 13 | suction |
| 14 | flowline |
| 15 | pump |
| 16 | separator |
| 17 | discharge line |
| 18 | discharge line |
| 19 | port |
| 20 | discharge |
| 21 | dye tracer tank |
| 22 | dye interface line |
| 23 | port |

TABLE-continued

| 32 PARTS LIST | |
|---|---|
| Part Number | Description |
| 24 | monitor |
| 25 | instrumentation line |
| 26 | valve |
| 27 | arrow |
| 28 | check valve |
| 29 | liquid waste discharge channel |
| 30 | apparatus |
| 31 | screened suction inlet |
| 32 | pump |
| 33 | separator |
| 34 | flowline |
| 35 | monitor |
| 36 | instrumentation line |
| 37 | control valve |
| 38 | check valve |
| 39 | discharge line |
| 40 | dye tracer tank |
| 41 | dye interface line |
| 42 | inlet port monitor |
| 43 | discharge port |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for marking unauthorized discharge of a liquid waste product flow stream from a marine vessel, refinery, or factory via a discharge flow line comprising:

a) a supply tank for containing a dye tracer product within the confines of the vessel, refinery, or factory;

b) an interface line for adding the dye product to the discharge flow line of the marine vessel, refinery, or factory;

c) valve controller means for valving the flow of dye product between the supply tank and the discharge line;

d) activating means for activating the valve controller responsive to the sensing of a preset level of liquid waste product flow being discharged via the discharge line so that unauthorized discharges of liquid waste product material from the via the discharge line automatically activates the valve controller to mix a dye product contained within the supply tank with the unauthorized waste product liquid discharge.

2. The apparatus of claim 1 wherein the supply is a container carrying a liquid dye.

3. The apparatus of claim 2 wherein the liquid dye carries magnetic material.

4. The apparatus of claim 1 wherein the activating means includes a flow sensor that senses fluid flow in the overboard discharge line.

* * * * *